US005717407A

United States Patent [19]

Hong

[11] Patent Number: 5,717,407

[45] Date of Patent: Feb. 10, 1998

[54] PATCH ANTENNA ARRAY CAPABLE OF SIMULTANEOUSLY RECEIVING DUAL POLARIZED SIGNALS

[75] Inventor: Seong-Hun Hong, Seoul, Rep. of Korea

[73] Assignee: Daewoo Electronics, Seoul, Rep. of Korea

[21] Appl. No.: 618,669

[22] Filed: Mar. 19, 1996

[30] Foreign Application Priority Data

Mar. 31, 1995 [KR] Rep. of Korea ..... 95-7303

[51] Int. Cl.[6] ..... H01Q 1/38

[52] U.S. Cl. ..... 343/700 MS; 343/851

[58] Field of Search ..... 343/700 MS, 778, 343/851; H01Q 1/38

[56] References Cited

U.S. PATENT DOCUMENTS 5,510,803 4/1996 Ishizaka et al. ..... 343/700 MS

*Primary Examiner*—Michael C. Wimer
*Attorney, Agent, or Firm*—Anderson Kill & Olick P.C.

[57] ABSTRACT

A patch antenna array capable of simultaneously receiving signals polarized in orthogonal or opposite directions, i.e. vertical and horizontal or right-handed and left-handed circular directions, comprises an electrical signal outputting means for outputting electrical signals generated in response to the orthogonally polarized signals through two output feedlines, a plurality of lower patch antennas, a lower feedline with one end that connects to the electrical signal outputting means and the other end that branches out and connects to each of the lower patch antennas, a plurality of upper patch antennas capable of receiving signals with the orthogonal polarizations in relation to signals received by the lower patch antennae, and an upper feedline with one end that connects to the electrical signal outputting means and the other end that branches out and connects to each of the upper patch antennae. Such a patch antenna array can simultaneously receive two orthogonally polarized signals, convert them into their corresponding electrical signals, and expediently output them via the output feedlines.

8 Claims, 7 Drawing Sheets

PATCH ANTENNA ARRAY CAPABLE OF SIMULTANEOUSLY RECEIVING DUAL POLARIZED SIGNALS

FIELD OF THE INVENTION

The present invention relates to a patch antenna array, and more particularly, to a patch antenna array capable of simultaneously receiving dual polarized signals.

DESCRIPTION OF THE PRIOR ART

Referring to FIG. 1, there is illustrated a parabolic reflector antenna 100 for receiving radio signals. The parabolic reflector antenna 100 comprises a reflector 10, a feedhorn 20, a low noise block-down ("LNB") converter 30, and a receiver 40.

The parabolic reflector antenna 100 described above operates to focus the radio signals onto the feedhorn 20 by means of the reflector 10. The focused radio signals are then processed by the LNB converter 30. The processed radio signals are then converted into electrical signals and outputted by the receiver 40.

However, the antenna 100 described above suffers from the disadvantage that it is bulkier and more difficult to handle or to install than planar antennas. In addition, precipitation accumulates easily on the reflector 10, adversely affecting performance of the antenna 100.

Referring to FIG. 2, there is illustrated a four element subarray unit of a conventional patch antenna array for receiving radio signals. The array comprises a plurality of patch antennas 210, and a feedline 220.

The patch antennas 210 and the feedline 220 are made of an electrically conducting material. One end of the feedline 220 branches out and connects to each patch antenna 210 in the array, while a remaining end combines the outputs from all the patch antennas 210 and outputs a resultant signal. Thus, incident radio signals are converted into electrical signals by the patch antennas 210 and outputted via the feedline 220.

The feedline 220 is composed of a plurality of straight sections, each of the sections having a length of multiples of $\lambda/2$, where $\lambda$ is a wavelength of the radio signals intended to be received by the patch antenna array. In addition, the feedline 220 is laid out such that the electrical signal from each patch antenna 210 travels a same total distance before it is outputted.

FIG. 3A shows a patch antenna 210 incorporated in the antenna array of FIG. 2, capable of receiving linearly polarized radio signals. The patch antenna 210 has a square shape, with all of its sides having a same length L, with the condition that:

$$L<\lambda_0 \qquad \text{Eq.1}$$

wherein $\lambda_0$ is a wavelength in vacuum of the radio signals that are intended to be received by the patch antenna array.

In addition, the feedline 220 attaches perpendicularly to the patch antenna 210 at a midpoint of one of its sides. Also, as shown in FIG. 2, the feedline 220 is oriented so that it attaches to each patch antenna 210 in a horizontal orientation. It should be noted that, in this specification, unless otherwise defined and obvious from the context, directions, such as vertical or horizontal, are defined in a plane parallel to a face of the planar antenna.

The shape of the patch antenna 210 and the manner in which it is connected to the feedline 220 determine the polarity, i.e., horizontal or vertical, of the radio signals that can be received. Thus, the polarization of the signals to be received by the patch antennas array shown in FIG. 2 may be changed by reorienting the patch antennae 210 and the feedline 220 so that the feedline 220 attaches vertically to the patch antennas 210.

Alternatively, it is possible to incorporate patch antennas with different shapes in the patch antenna array shown in FIG. 2. FIG. 3B illustrates a notched patch antenna 215 capable of receiving circularly polarized signals. The notched patch antenna 215 has a hexagonal shape obtained by removing two diagonally opposite, i.e., non-adjacent, corners from a square. How much of the corners is to be removed will depend on the characteristics of the patch antenna 215, such as its surface area, its composition, etc.

The polarization, i.e., right-handed or left-handed, of the signals that can be received by the patch antenna array incorporating the notched patch antenna 215 depends on the manner in which the feedline 220 is attached to each of the notched patch antennas 215 and on which corners thereof are removed. Assuming that an upper left and a lower right corners of the notched patch antenna 215 are removed, the polarization of the signals to be received may be changed by attaching the feedline 220 to the notched patch antenna 215 in a vertical orientation, instead of a horizontal orientation, as shown in FIG. 3B.

However, to increase the information capacity of a frequency band, it is common practice to transmit two separate signals polarized in opposite or orthogonal directions, i.e., one right-handed circular and the other left-handed circular or one horizontal and the other vertical, within the same frequency band. This practice called frequency reuse is made possible due to the fact that two signals polarized in orthogonal or opposite directions can be completely separated at a receiving end. The patch antenna array described above, incorporating the patch antenna element of FIG. 3A or FIG. 3B, is only capable of receiving signals polarized in one direction. Thus, the patch antenna array described above is not capable of receiving all the information contained within a frequency band that includes two separate signals.

SUMMARY OF THE INVENTION

It is, therefore, a primary object of the present invention to provide a patch antenna array capable of simultaneously receiving two separate signals polarized in orthogonal or opposite, i.e., one vertical and the other horizontal or one right-handed circular and the other left-handed circular, directions.

In accordance with a preferred embodiment of the present invention, there is provided a patch antenna array capable of simultaneously receiving two separate signals polarized in orthogonal or opposite directions, i.e., one vertical and the other horizontal or one left-handed circular and the other right-handed circular, wherein the vertical, horizontal, left-handed circular, and right-handed circular directions are defined in a plane parallel to a face of the patch antenna array, and including two output feedlines for outputting electrical signals generated in response to the two separate polarized signals, the patch antenna array comprising: means for outputting the electrical signals generated in response to the two separate polarized signals through the two output feedlines; a grounding layer; a first insulating layer formed on top of the grounding layer; a plurality of lower patch antennas, formed on top of the first insulating layer, and capable of receiving one of the two separate polarized signals; a lower feedline that is formed on top of the first insulating layer, and one end of which is connected to the electrical signal outputting means and the other end of which branches out and connects to each of the lower patch antennas, the lower patch antennas and the lower feedline being connected in such a manner that the lower patch antennas receives one of the two separate polarized signals; a second insulating layer formed on top of the lower patch antennas, the lower feedline, and any portions of the first insulating layer not covered by the lower patch antennas or the lower feedline; a lower shielding layer formed on top of the second insulating layer while leaving uncovered portions of the second insulating layer that cover the lower patch antennae; a third insulating layer formed on top of the lower shielding layer and any portions of the second insulating layer not covered by the lower shielding layer; a plurality of upper patch antennae, formed on top of the third insulating layer directly above and at a predetermined distance D from the lower patch antennas, wherein the predetermined distance D is determined experimentally and determines a bandwidth of the signals received by the patch antenna array, and capable of receiving the remaining one of the two separate polarized signals, i.e., a signal polarized in a direction orthogonal or opposite to the polarization direction of the signal received by the lower patch antennas; an upper feedline formed on top of the third insulating layer, one end of which is connected to the electrical signal outputting means and the other end of which branches out and is connected to each of the upper patch antennae, the upper patch antennas and the upper feedline being connected in such a manner that the upper patch antennas receives said remaining one of the two separate polarized signals; a fourth insulating layer formed on top of the upper patch antennas, the upper feedline, and any portions of the third insulating layer not covered by the upper patch antennas or the upper feedline; and an upper shielding layer formed on top of the fourth insulating layer while leaving uncovered portions of the fourth insulating layer that cover the upper patch antennas.

BRIEF DESCRIPTION OF THE DRAWINGS

The above and other objects and features of the present invention will become apparent from the following description taken in conjunction with the accompanying drawings, in which:

FIG. 7 exemplifies a cut-away view of the electrical signal outputting means incorporated in the inventive patch antennae array.

DETAILED DESCRIPTION OF THE PREFERRED EMBODIMENTS

Figure 1:
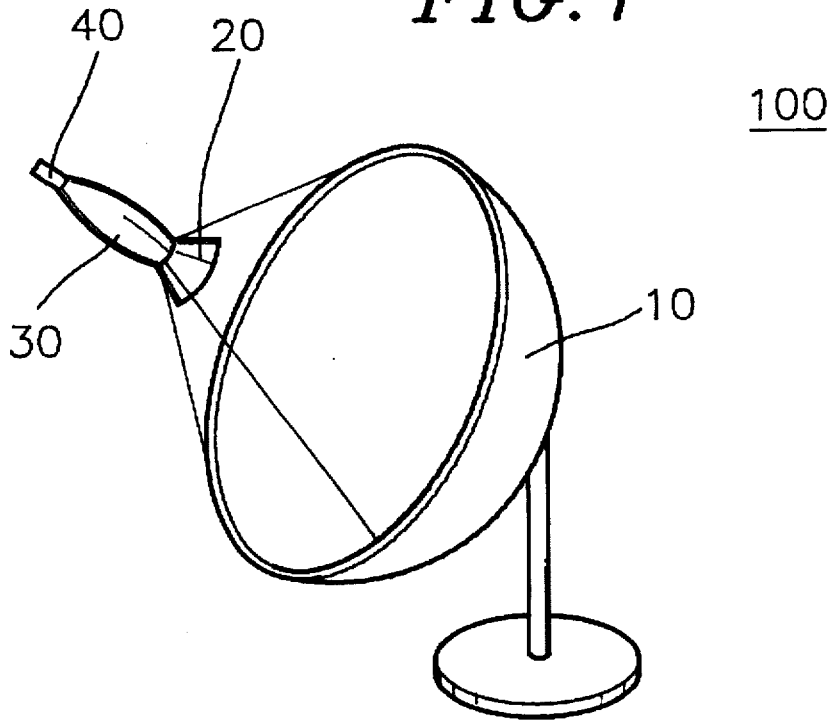
FIG. 1 presents a perspective view of a conventional parabolic reflector antenna.
Figure 2:
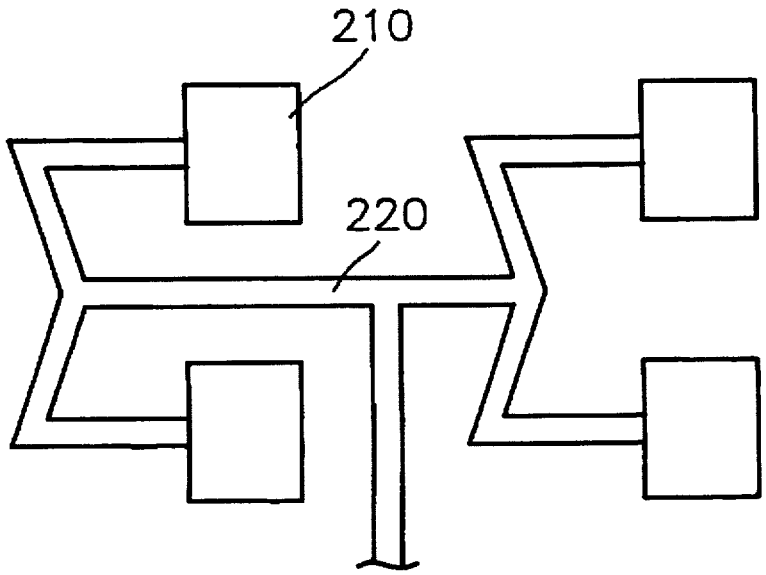
FIG. 2 illustrates a schematic view of a four element subarray unit of a conventional patch antenna array.
Figure 3A:
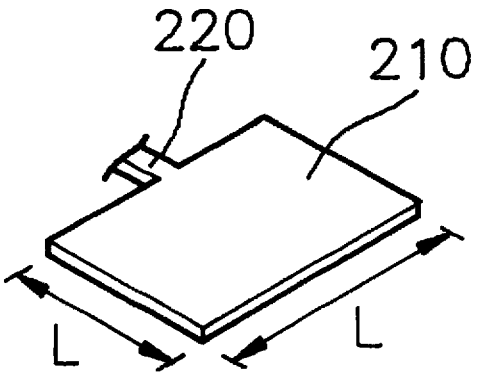
FIG. 3A and 3B show perspective views of a patch antenna element of a conventional patch antennas.
Figure 3B:
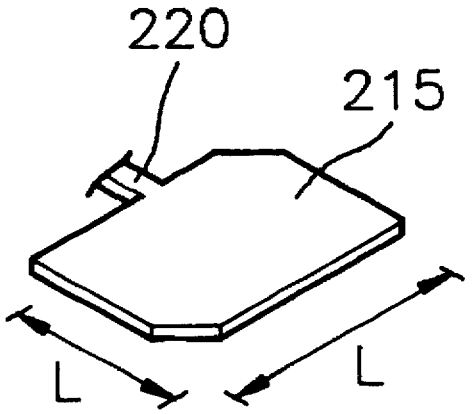
Figure 4:
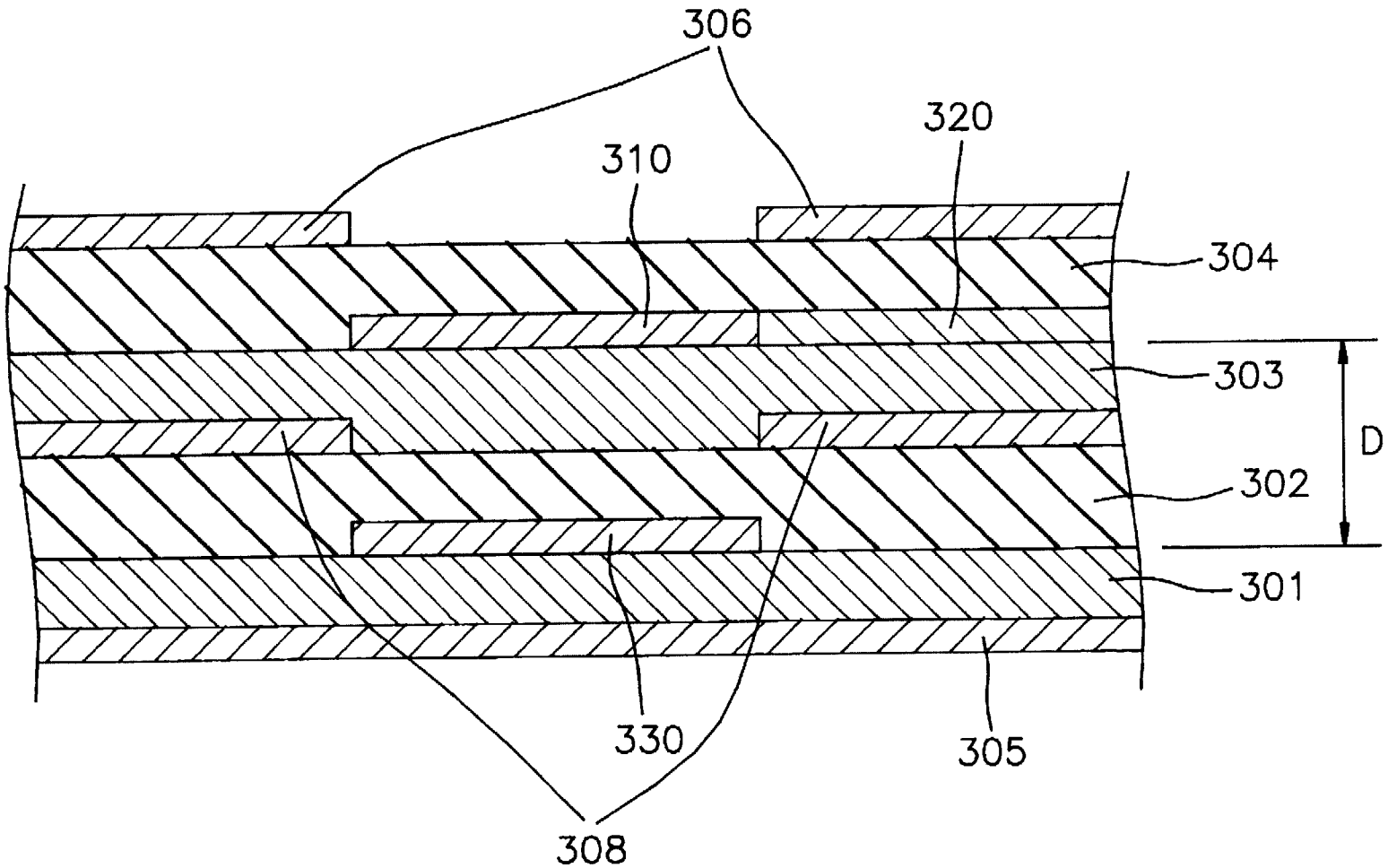
FIG. 4 offers a cross sectional view of a portion of an inventive patch antennas array.

Referring to FIG. 4, there is shown a cross sectional view of a portion of a patch antenna array in accordance with a preferred embodiment of the present invention, capable of simultaneously receiving two separate signals polarized in opposite or orthogonal directions, i.e., one left-handed circular and the other right-handed circular or one horizontal and the other vertical directions, wherein the left-handed circular, right-handed circular, horizontal, and vertical directions are defined in a plane parallel to a face of the patch antenna array. The patch antenna array comprises a grounding layer 305, a first insulating layer 301, a plurality of lower patch antennas 330, an equal plurality number of upper patch antennas 310, a lower feedline 340 (see FIG. 6), a second insulating layer 302, a lower shielding layer 308, a third insulating layer 303, an upper feedline 320, a fourth insulating layer 304, an upper shielding layer 306, and an electrical signal outputting unit 350 (see FIG. 6).

Figure 6:
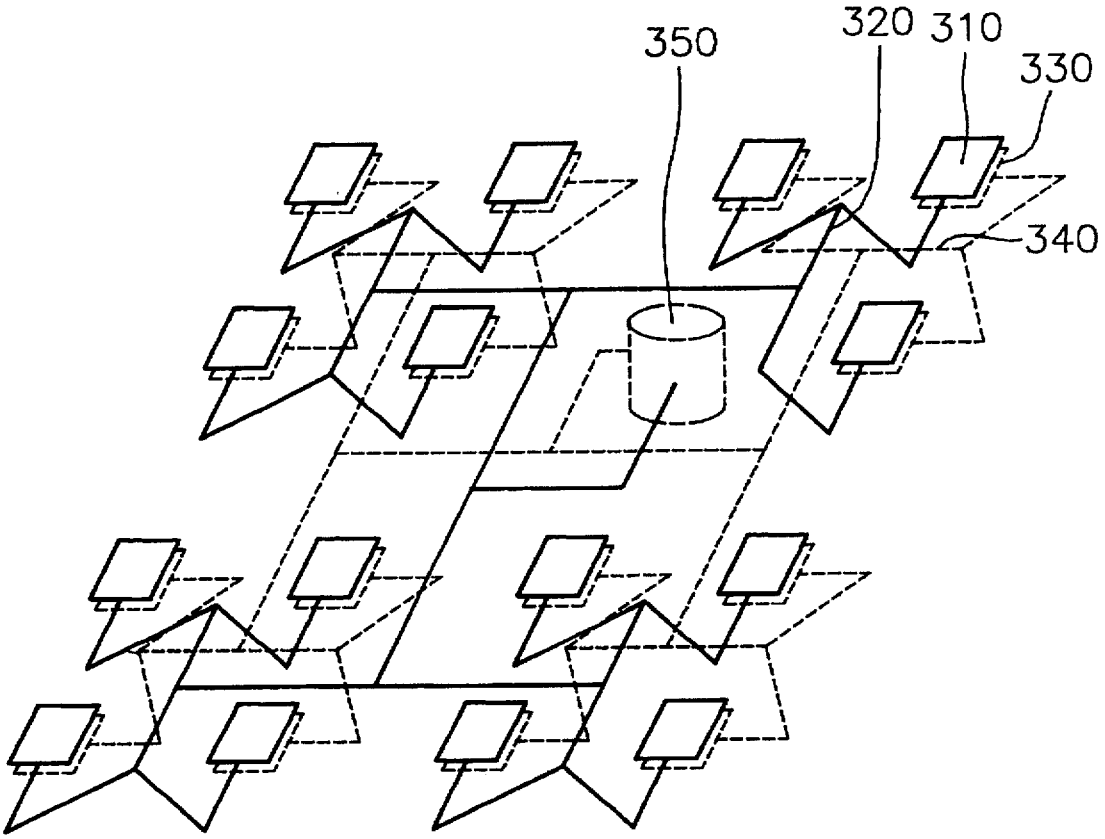
FIG. 6 represents a schematic view of the inventive patch antenna array.

The first insulating layer 301 is located on top of the grounding layer 305. The lower patch antennas 330 and the lower feedline 340, in turn, are formed on top of the first insulating layer 301. As can be seen in FIG. 6, one end of the lower feedline 340 branches out and attaches to each of the lower patch antennas 340, while the remaining end is connected to the electrical signal outputting unit 350.

The second insulating layer 302 is formed on top of the lower patch antennas 330 and the lower feedline 340 and any portions of the first insulating layer 301 not covered by the lower patch antennas 330 and the lower feedline 340.

The lower shielding layer 308 is then formed on top of the second insulating layer 302, completely covering it, except the portions thereof that cover the lower patch antennas 330. The lower shielding layer 308, and the portions of the second insulating layer 302 not covered by it, in turn, are covered by the third insulating layer 303.

The upper patch antennas 310 and the upper feedline 320 are formed on top of the third insulating layer 303. It should be noted that the upper patch antennas 310 are located directly above the lower patch antennas 330 at a predetermined distance D. It should be noted that D determines a bandwidth of the signals received by the patch antennas array, and is determined experimentally. In addition, as shown in FIG. 6, one end of the upper feedline 320 branches out to attach to each of the upper patch antennas 310. As with the lower feedline 340, the remaining end of the upper feedline 320 is connected to the electrical signal outputting unit 350.

The upper patch antennas 310, the upper feedline 320, and the portions of the third insulating layer 303 not covered by them, in turn, are covered by the fourth insulating layer 304.

The upper shielding layer 306 covers the fourth insulating layer 304 while leaving exposed the portions directly above the upper patch antennas 310.

The insulating layers 301,302, 303, 304 discussed above are made of an electrically insulating material. However, in the alternative, it is also possible to form the insulating layers 301, 302, 303, 304 with a dielectric material, e.g., expanded poly-ethylene. The shielding layers 308,306 and the grounding layer 305 are made of an electrically conducting material. To allow effective shielding, the shielding layers 308,306 are electrically connected to the grounding layer 305 by, e.g., wires (not shown).

In addition, the patch antenna array also includes two output feedlines 325, 345, (see FIG. 7) which are located below the grounding layer 305.

Figure 5A:
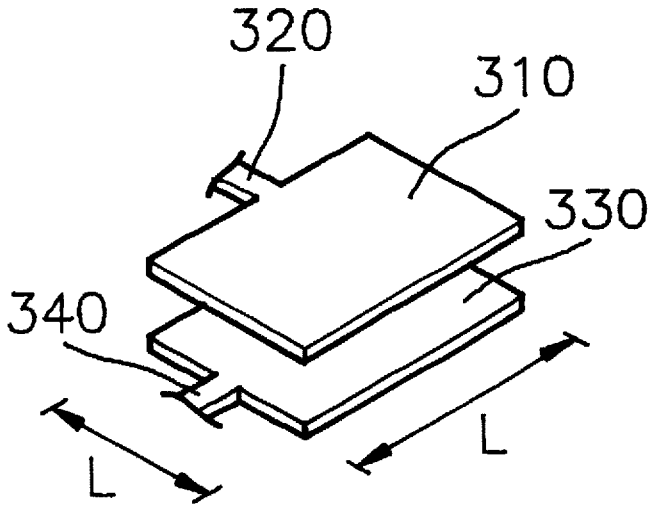
FIGS. 5A and 5B provide perspective views of a patch antenna element incorporated in the inventive patch antennas array.

FIG. 5A is a perspective view of an antenna element consisting of one upper patch antenna 310 and one lower patch antenna 330 incorporated in the patch antenna array in accordance with the present invention. The upper and lower patch antenna 310, 330 have a square shape, with each of their sides having a same length L, with the condition that:

$$<\lambda_0 \quad \text{Eq.2}$$

wherein $\lambda_0$ is a wavelength in vacuum of the radio signals received by the patch antenna array. In addition, the upper and the lower patch antennas 310, 330 are positioned so that each of the upper patch antennas 310 is directly above its corresponding lower patch antenna 330.

The upper feedline 320 and the lower feedline 340 attach perpendicularly to a midpoint of one side of the upper patch antenna 310 and the lower patch antenna 330, respectively. It should be noted that the upper feedline 320 and the lower feedline 340 are also perpendicular to each other at the point where they attach to their respective patch antennas. In other words, if the upper feedline 320 attaches in a horizontal orientation to the upper patch antenna 310, the lower feedline 340 attaches in a vertical orientation to the lower patch antenna 340.

The upper and the lower patch antennas 310, 330, described above, are capable of receiving linearly polarized signals and converting them into electrical signals. Since the upper feedline 320 and the lower feedline 340 are perpendicular to each other at the point where they attach to their respective patch antenna, signals received by the upper patch antenna 310 and signals received by the lower patch antenna 330 will be polarized in orthogonal directions. The electrical signals generated by the upper and the lower patch antennas 310, 330 are then sent to the electrical signal outputting unit 350 by the upper and the lower feedlines 320, 340, respectively.

In the alternative, the patch antenna array in accordance with the present invention may be made to receive circularly polarized signals by employing therein patch antennas with different shapes.

Figure 5B:
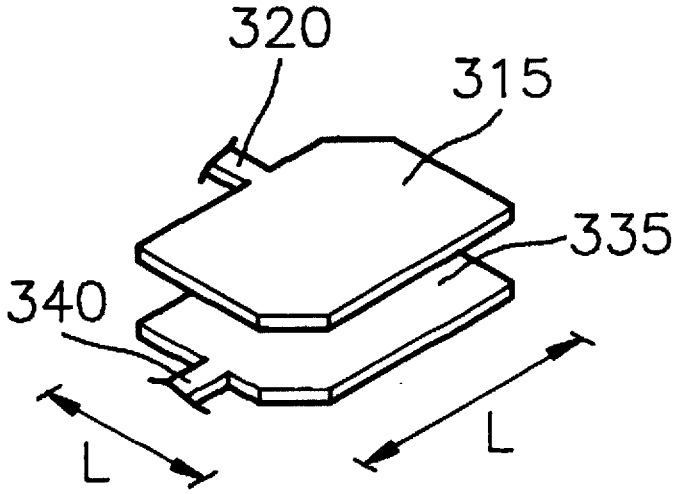

FIG. 5B presents a perspective view of one notched upper patch antenna 315 and one notched lower patch antenna 335 capable of receiving circularly polarized signals. As with the patch antennas 310, 330 shown in FIG. 5A, the notched upper patch antenna 315 is positioned directly above the notched lower patch antenna 335. In addition, the upper feedline 320 and the lower feedline 340 are perpendicular to each other at a point where they attach to the notched upper patch antenna 315 and the notched lower patch antenna 335, respectively.

The notched upper patch antenna 315 and the notched lower patch antenna 335 have hexagonal shapes obtained by removing two diagonally opposite, i.e., non-adjacent, corners. Depending on which corners are removed, and on an orientation of the feedline at the point where it attaches to the notched patch antenna, either right-handed circularly polarized signals or left-handed circularly polarized signals will be received. Since the upper feedline 320 and the lower feedline 340 are perpendicular to each other at the point where they attach to their respective patch antennas, the patch antenna array incorporating the notched upper and the notched lower patch antennas 315, 335 in accordance with the present invention is capable of simultaneously receiving both right-handed and left-handed circularly polarized signals.

Referring to FIG. 6, there is illustrated a schematic diagram of a patch antenna array in accordance with the present invention. As can be seen, each one end of the upper and lower feedlines 320, 340 branches out to each of the upper patch antennas 310 and the lower patch antennae 330, respectively. The remaining each end of the upper and the lower feedlines 320, 340 connects to the electrical signal outputting unit 350. The upper and the lower feedlines 320, 340 are composed of a plurality of straight sections, with each of the sections having a length equivalent to multiples of λ2, wherein k is a wavelength of the signals received by the patch antenna array. In addition, for the electrical signals generated in response to the incident radio signals to be outputted properly, they have to travel a same total distance to be outputted. This requirement dictates that the upper and the lower feedlines 320, 340 have to be laid out such that a path through the feedlines from each of the upper and the lower patch antennas 310, 330 to the electrical signal outputting unit 350 is of a same length.

The requirement that the electrical signals generated in response to the incident radio signals received by each of the patch antennas 310, 330 or 315, 335 have to travel the same total distance imposes an added difficulty in outputting the electrical signals. As illustrated in FIG. 6, to ensure that the electrical signals all travel the same distance to be outputted, the feedlines 320, 340 are laid out so that branches thereof that connect to each of the patch antennas first converge to a center of the patch antenna array. Although it would be possible to extend the remaining, i.e., the outputting, end of the feedlines 320, 340 from the center of the patch antenna array through gaps between the individual upper and the lower patch antennas, the patch antennae array in accordance with the preferred embodiment of the present invention utilizes the electrical signal outputting unit 350 which communicates the electrical signals carried by the feedlines 320, 340 to the two output feedlines 325, 345 located below the grounding layer 305, thereby making it possible to arrange the patch antennas 310, 330 closer together and making it easier to find a working arrangement of the feedlines and the patch antennas.

Figure 7:
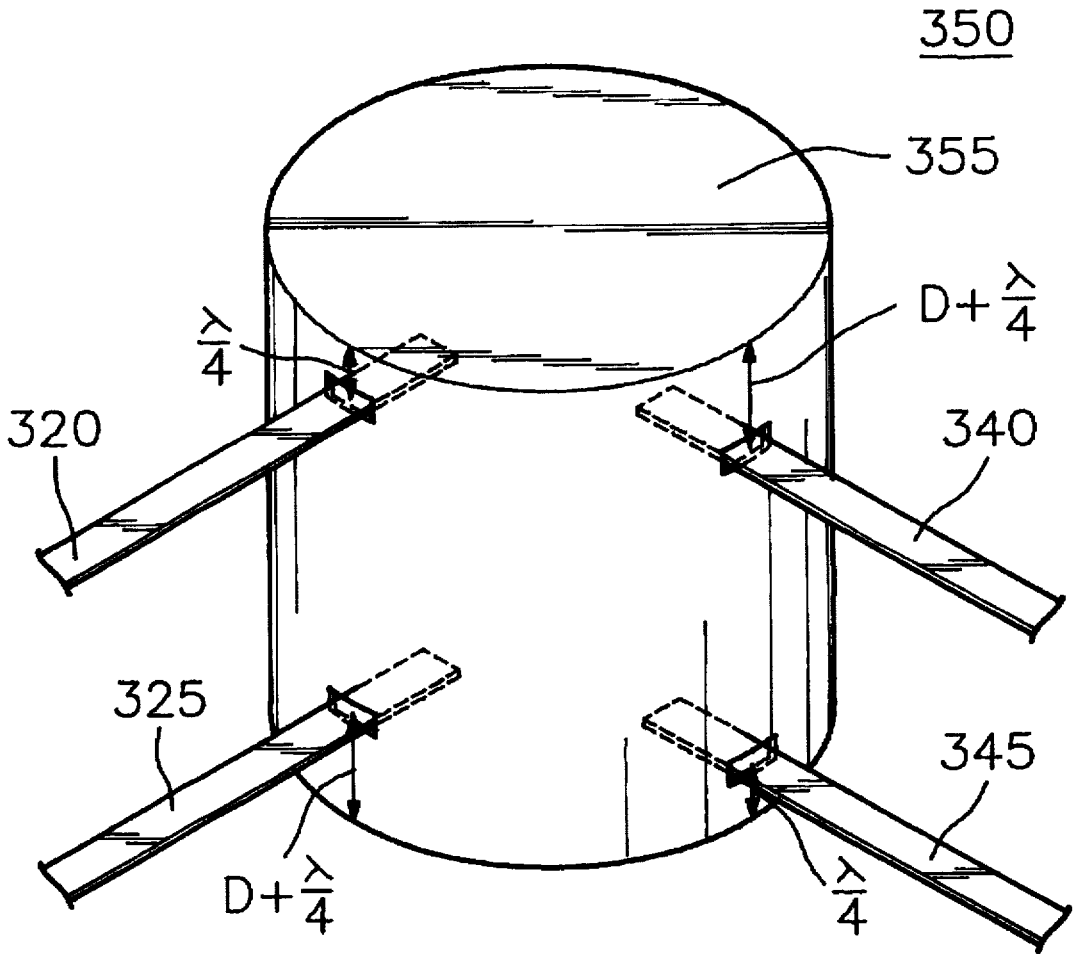
FIG. 7 exhibits a perspective view of an electrical signal outputting means incorporated in the inventive patch antennas arrray.

As shown in FIG. 7, the electrical signal outputting unit 350 incorporated in the patch antenna array in accordance with the present invention includes a waveguide (not shown) formed by a hollow cylinder 355. The cylinder 355, which is made of, e.g., an electrically conducting materila, is fitted into a hole (not shown) bored through the layers of the patch antenna array, and interacts with four feedlines; the upper and the lower feedlines 320, 340, the output upper feedline 325, and the output lower feedline 345. The four feedlines protrude slightly into the cylinder 355 through two upper holes (not shown) and two lower holes (not shown). The two upper holes that the upper and lower feedlines 320, 340 protrude through are prepared at distances of λ/4 and D+λ/4, respectively, from a top surface (not shown) of the cylinder 355, and are separated by an arc distance of 90° In turn, the output upper and lower feedlines 325,345 protrude into the cylinder 355 through the two lower holes, which are prepared at distances of D+λ/4 and λ/4, respectively, from a bottom surface (not shown) of the cylinder 355. The upper and lower holes corresponding to the feedlines 340, 345 are offset downwardly by the predetermined distance D due to the fact that the lower feedline 340 is formed the predetermined distance D below the upper feedline 320. It should be noted that the two lower holes are located directly below the two upper holes and that the output upper and lower feedlines 325, 345 have a same orientation as, and are directly below, the upper and lower feedlines 320, 340, respectively. In addition, it should also be noted that the feedlines 320, 340, 325, 345 protrude into, but do not physically contact, the cylinder 355.

Figure 8:
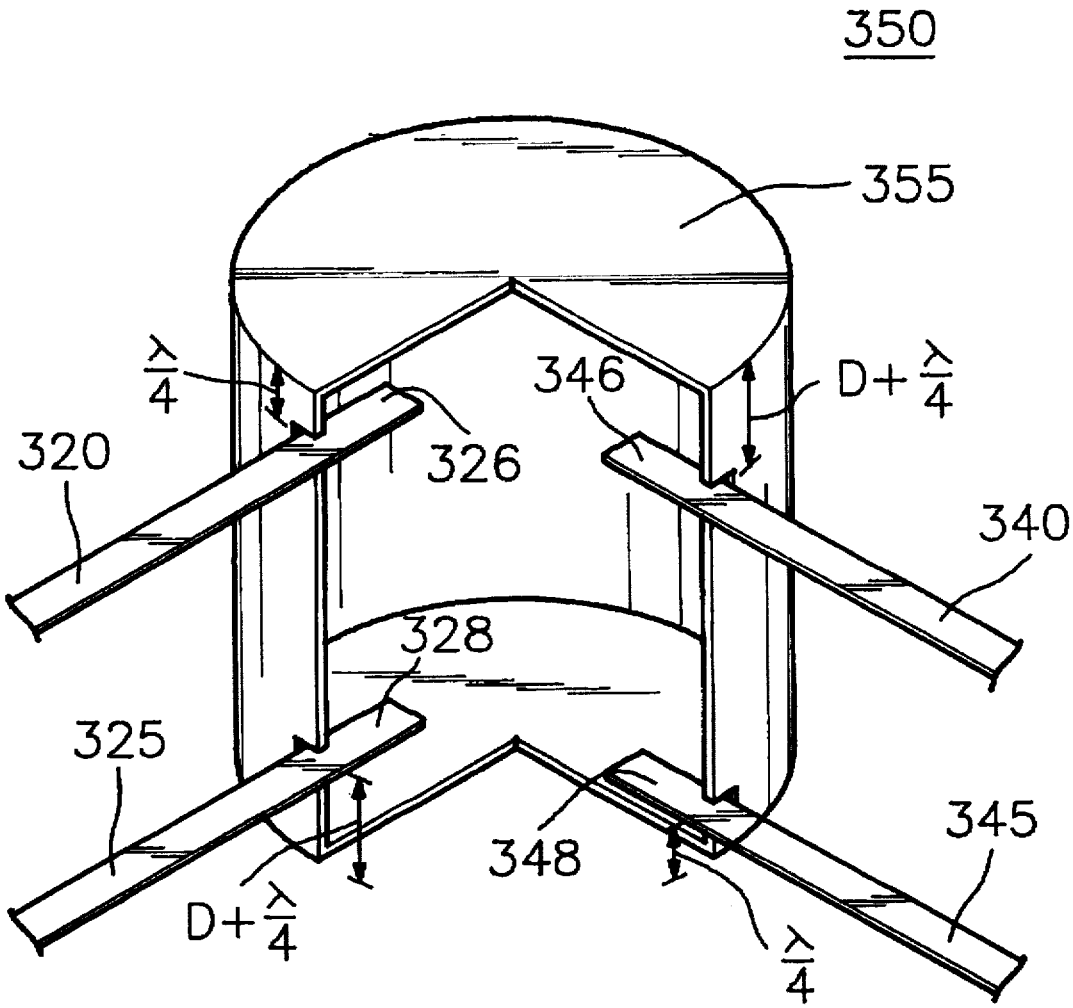

FIG. 8 presents a cutaway view of the electrical signal outputting unit 350 incorporated in the patch antenna array in accordance with the present invention. The portions of the two feedlines 320, 340 that protrude into the cylinder 355 constitute two input dipole antennas 326, 346, respectively. Similarly, the portions of the two output feedlines 325, 345 that protrude into the cylinder 355 constitute two output dipole antennas 328, 348, respectively. The four dipole antennas 326, 346, 328, 348 have a same length and allow the electrical signals from the feedlines 320, 340 to communicate with the output feedlines 325, 345, respectively. Thus, by placing the electrical signal outputting unit 350 in a middle point of the inventive patch antenna array, it is possible to facilitate the outputting of the electrical signals.

While the present invention has been shown and described above with respect to the particular embodiments, it will be apparent to those skilled in the art that many changes, alterations and modifications may be made without departing from the spirit and scope of the invention as defined in the appended claims.

What is claimed is:

1. A patch antenna array capable of simultaneously receiving two separate signals polarized in vertical and horizontal directions, respectively, wherein the vertical and horizontal directions are defined on a plane parallel to the face of the patch antenna array, and including two output feedlines for outputting electrical signals generated in response to the two separate polarized signals, the patch antenna array comprising:

a plurality of lower patch antennas, capable of receiving one of the two separate polarized signals and generating electrical signals in response thereto;

a lower feedline, one end of which is connected to electrical signal outputting means and the other end of which is connected to each of the lower patch antennas, the lower patch antennas and the lower feedline being connected in such a manner that the lower patch antennas are capable of receiving one of the two separate polarized signals;

a lower shielding layer formed at a first predetermined distance above the lower patch antennas and the lower feedline, entirely covering the lower feedline while leaving the lower patch antennas uncovered;

a plurality of upper patch antennas formed at a second predetermined distance above the lower shielding layer, directly above and at a predetermined distance D from the lower patch antennas, wherein said D is experimentally established and determines a bandwidth of the signals received by the patch antenna array, capable of receiving the remainder of the two separate polarized signals and generating electrical signals in response thereto;

an upper feedline formed at the second predetermined distance above the lower shielding layer, one end of which is connected to the electrical signal outputting means and the other end of which is connected to each of the upper patch antennas, the upper patch antennas and the upper feedline being connected in such a manner that the upper patch antennas are capable of receiving the remainder of the two separate polarized signals;

an upper shielding layer formed at a third predetermined distance above the upper patch antennas and the upper feedline, entirely covering the upper feedline while leaving the upper patch antennas uncovered; and means for outputting the electrical signals generated in response to the two separate polarized signals through the two output feedlines, wherein the electrical signal outputting means includes a hollow cylinder, located near a center of the patch antenna array, and provided with a first upper hole formed at a distance of $\lambda/4$ from a top surface of the cylinder that allows the upper feedline to extend a predetermined length into the cylinder to thereby form a first input dipole antenna, a second upper hole formed at a distance of $D+\lambda/4$ from the top surface of the cylinder and at an arc distance of 90° from the first upper hole that allows the lower feedline to extend the predetermined length into the cylinder to thereby form a second input dipole antenna, a first lower hole formed directly below the first upper hole at a distance of D+/4 from a bottom surface of the cylinder that allows one of the two output feedlines to extend the predetermined length into the cylinder to thereby form a first output dipole antenna, and a second lower hole formed directly below the second upper hole at a distance of $\lambda/4$ from the bottom surface of the cylinder that allows the remaining output feedline to extend, by the predetermined length, into the cylinder to thereby form a second output dipole antenna.

2. The patch antenna array of claim 1, wherein the upper and the lower patch antennas have a square shape, whereby the polarized signals are respectively vertically and horizontally polarized.

3. The patch antenna array of claim 1, wherein the upper and the lower patch antennas are of a shape defined by a square with at least one diagonally-truncated corner, whereby the polarized signals are right- and left-handed circularly polarized, respectively.

4. The patch antenna array of claim 1, wherein at least one upper patch antenna has a square shape and at least one lower patch antenna is of a shape defined by a square with at least one diagonally-truncated corner.

5. A patch antenna array capable of simultaneously receiving two separate signals polarized in right-handed and left-handed circular directions, wherein the right-handed and left-handed circular directions are defined in a plane parallel to the face of the patch antenna array, and including two output feedlines for outputting electrical signals generated in response to the right-handed and the left-handed circularly polarized signals, the patch antenna array comprising:

a grounding layer;

a plurality of lower patch antennas capable of receiving either the right-handed or the left-handed circularly polarized signals and generating electrical signals in response thereto;

a lower feedline, one end of which is connected to electrical signal outputting means and the other end of which is connected to each of the lower patch antennas, the lower patch antennas and the lower feedline being connected in such a manner that the lower patch antennas are capable of receiving either the right-handed or the left-handed circularly polarized signals;

a lower shielding layer formed at a first predetermined distance above the lower patch antennas and the lower feedline, entirely covering the lower feedline while leaving uncovered the lower patch antennas;

a plurality of upper patch antennas formed at a second predetermined distance above the lower shielding layer, directly above and at a predetermined distance D from the lower patch antennas, wherein said D is experimentally established and determines a bandwidth of the signals received by the patch antenna array, capable of receiving the remainder of the two separate polarized signals and generating electrical signals in response thereto;

an upper feedline formed at the second predetermined distance above the lower shielding layer, one end of which is connected to the electrical signal outputting means and the other end of which is connected to each of the upper patch antennas, the upper patch antennas and the upper feedline being connected in such a manner that the upper patch antennas are capable of receiving the remainder of the two separate polarized signals;

an upper shielding layer formed at a third predetermined distance above the upper patch antennas and the upper feedline, entirely covering the upper feedline while leaving uncovered the upper patch antennas; and means for outputting the electrical signals generated in response to the right-handed and the left-handed circularly polarized signals through the two output feedlines, wherein the electrical signal outputting means includes a hollow cylinder, located near a center of the patch antenna array, and provided with a first upper hole formed at a distance of $\lambda/4$ from a top surface of the cylinder that allows the upper feedline to extend a predetermined length into the cylinder to thereby form a first input dipole antenna, a second upper hole formed at a distance of D+/4 from the top surface of the cylinder and at an arc distance of 90° from the first upper hole that allows the lower feedline to extend the predetermined length into the cylinder to thereby form a second input dipole antenna, a first lower hole formed directly below the first upper hole at a distance of $D+\lambda/4$ from a bottom surface of the cylinder that allows one of the two output feedlines to extend the predetermined length into the cylinder to thereby form a first output dipole antenna, and a second lower hole formed directly below the second upper hole at a distance of $\lambda/4$ from the bottom surface of the cylinder that allows the remaining output feedline to extend by the predetermined length, into the cylinder to thereby form a second output dipole antenna.

6. The patch antenna array of claim 5, wherein the upper and the lower patch antennas have a square shape, whereby the polarized signals are respectively vertically and horizontally polarized.

7. The patch antenna array of claim 5, wherein the upper and the lower patch antennas are of a shape defined by a square with at least one diagonally-truncated corner, whereby the polarized signals are respectively right and left-handed circularly polarized.

8. The patch antenna array of claim 5, wherein at least one upper patch antenna has a square shape and at least one lower patch antenna is of a shape defined by a square with at least one diagonally-truncated corner.

* * * * *